US008016390B2

(12) United States Patent
Watanabe

(10) Patent No.: US 8,016,390 B2
(45) Date of Patent: Sep. 13, 2011

(54) LIQUID DISCHARGING HEAD AND INKJET HEAD

(75) Inventor: Hidetoshi Watanabe, Tokoname (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 139 days.

(21) Appl. No.: 12/413,433

(22) Filed: Mar. 27, 2009

(65) Prior Publication Data

US 2009/0244199 A1 Oct. 1, 2009

(30) Foreign Application Priority Data

Mar. 27, 2008 (JP) ..... 2008-084268

(51) Int. Cl.
*B41J 2/05* (2006.01)
*B41J 2/045* (2006.01)

(52) U.S. Cl. ..... 347/65; 347/71

(58) Field of Classification Search ..... 347/65, 347/68–72

See application file for complete search history.

(56) References Cited

U.S. PATENT DOCUMENTS

| | | | | |
|---|---|---|---|---|
| 7,311,380 | B2 | 12/2007 | Watanabe et al. | |
| 2002/0042994 | A1 | 4/2002 | Ito et al. | |
| 2004/0130594 | A1* | 7/2004 | Watanabe et al. | 347/40 |
| 2005/0036013 | A1 | 2/2005 | Watanabe et al. | |
| 2006/0132551 | A1 | 6/2006 | Chikamoto | |
| 2006/0158487 | A1 | 7/2006 | Ito et al. | |

FOREIGN PATENT DOCUMENTS

| | | | |
|---|---|---|---|
| EP | 1403054 | A1 | 3/2004 |
| JP | 2002-001953 | A | 1/2002 |
| JP | 2004-114477 | A | 4/2004 |
| JP | 2004-114520 | A | 4/2004 |
| JP | 2005-059337 | A | 3/2005 |
| JP | 2006-062259 | A | 3/2006 |
| JP | 2006-062260 | A | 3/2006 |
| JP | 2006-175683 | A | 7/2006 |
| JP | 2006-198903 | A | 8/2006 |

OTHER PUBLICATIONS

European Patent Office, European Search Report in counterpart Patent Application No. EP 09004396, mailed Jul. 1, 2009.

* cited by examiner

*Primary Examiner* — Geoffrey Mruk
(74) *Attorney, Agent, or Firm* — Baker Botts L.L.P.

(57) ABSTRACT

A liquid discharging head includes a flow path unit having a common liquid flow path; an individual liquid flow path; and a plurality of plates that are stacked to form the common liquid flow path and the individual liquid flow path. The plurality of plates includes at least four manifold plates that include partial plates and support members, wherein the at least four manifold plates comprise: a first manifold plate that includes a first partial plate and a first support member that supports the first partial plate; a second manifold plate that includes a second partial plate and a second support member that is adjacent to the first support member in a direction in which the common liquid path extends, the second support member supporting the second partial plate; and at least one manifold plate that is interposed between the first manifold plate and the second manifold plate.

9 Claims, 9 Drawing Sheets

LIQUID DISCHARGING HEAD AND INKJET HEAD

CROSS REFERENCE TO RELATED APPLICATION

The present application claims priority from Japanese Patent Application No. 2008-084268, which was filed on Mar. 27, 2008, the disclosure of which is herein incorporated by reference in its entirety.

TECHNICAL FIELD

Apparatuses consistent with the present invention relate to a liquid discharging head for discharging liquid droplets, and more particularly, an inkjet head for discharging ink droplets.

BACKGROUND

Japanese unexamined patent application publication No. JP-A-2004-114520 describes a related art inkjet head for discharging ink droplets. The related art inkjet head comprises a flow path unit in which a common ink chamber having a plurality of manifold flow paths and a plurality of individual ink flow paths which reach nozzles from outlets of the respective manifold flow paths via pressure chambers. This flow path unit has a stacked construction in which a plurality of plates are stacked. In addition, of the plurality of plates, manifold plates which configure parts of side walls of the manifold flow paths include island-like partial plates which are surrounded by the manifold flow paths. The partial plates are disposed so as to cross the manifold flow paths and are supported by rectangular support pieces which are connected to the side walls of the manifold flow path which confront each other.

SUMMARY

However, the related art inkjet head has a few disadvantages. For example, in the related art inkjet head, the three stacked manifold plates form the side walls of the manifold flow paths. In addition, since the manifold plate on which the support piece is formed lies adjacent to the different manifold plates on which the support piece is formed which lies adjacent to the support piece in a direction in which the manifold flow paths extend, the support pieces which lie so adjacent are close to each other with respect to the stacking direction of the manifold plates. Because of this, bubbles which have flowed into the manifold flow paths are held between the support pieces which lie adjacent and become easy to stay within the manifold flow paths. When such bubbles stay within the manifold flow paths, since the flow of ink within the manifold flow paths is interrupted, the bubbles so staying need to be discharged to the outside of the manifold flow paths. However, in order to discharge the bubbles staying in the manifold flow paths therefrom, a large amount of ink also needs to be discharged together with the bubbles, and hence, ink is consumed wastefully.

Accordingly, it is an aspect of the present invention is to provide a liquid discharging head and an inkjet head which can discharge with good efficiency bubbles that have flowed into common liquid flow paths.

Exemplary embodiments of the present invention address the above disadvantages described above and other disadvantages not described above. However, the present invention is not required to overcome the disadvantages described above, and thus, an exemplary embodiment of the present invention may not overcome any of the problems described above.

According to an exemplary embodiment of the present invention, there is provided a liquid discharging head comprising: a flow path unit comprising: a common liquid flow path; an individual liquid flow path that reaches a nozzle from an outlet of the common liquid flow path; and a plurality of plates that are stacked to form the common liquid flow path and the individual liquid flow path, the plurality of plates comprising at least four manifold plates that include partial plates and support members, wherein each of the at least four manifold plates comprises: a respective one of the partial plates, which has an island shape, and which is surrounded by the common liquid flow path; and a respective one of the support members that connects walls of the partial plates to side walls of the common liquid flow path so as to cross the common liquid flow path, the side walls of the common liquid flow path comprising the walls of the partial plates, and wherein the at least four manifold plates comprise: a first manifold plate that includes a first partial plate and a first support member that supports the first partial plate; and a second manifold plate that includes a second partial plate and a second support member that is adjacent to the first support member in a direction in which the common liquid path extends, the second support member supporting the second partial plate; and at least one manifold plate that is interposed between the first manifold plate and the second manifold plate.

According to the aspect of the invention, since the distance between the support pieces which lie adjacent to each other in the direction in which the common liquid flow paths extend with respect to the stacking direction becomes wide, the staying of bubbles between the adjacent support pieces can be suppressed. By this configuration, bubbles that have flowed into the common liquid flow paths can be discharged with good efficiency.

According to an another aspect of the present invention, there is provided a inkjet head comprising: a flow path unit comprising: a common ink flow path; a plurality of branch ink flow paths that branch off from the common ink flow path; a plurality of individual ink flow paths that reach nozzles from outlets of the branch ink flow paths through pressure chambers; and a plurality of metallic plates that are stacked to form the common liquid flow path, the branch ink flow paths and the individual liquid flow paths, the plurality of metallic plates comprising at least four manifold plates that include the common liquid flow path, the branch ink flow paths, partial plates and support members, wherein each of the at least four manifold plates comprises: a respective one of the partial plates, which has an island shape, and which is surrounded by a respective one of the branch ink flow paths; and a respective one of the support members that connects side walls of the respective branch ink flow path so as to support the respective partial plate and to cross the common liquid flow path, and wherein the at least four manifold plates comprise: a first manifold plate that includes a first partial plate and a first support member that supports the first partial plate; and a second manifold plate that includes a second partial plate and a second support member that is adjacent to the first support member in a direction in which the branch ink flow paths extend, the second support member supporting the second partial plate; and at least one manifold plate that is interposed between the first manifold plate and the second manifold plate.

According to the aspects of the invention, since the distance between the adjacent support pieces with respect to the stacking direction becomes wide, the staying of bubbles between the adjacent support pieces can be suppressed. Because of this, bubbles that have flowed into the common liquid flow paths can be discharged therefrom with good efficiency.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

Hereinafter, an exemplary embodiment of the invention will be described by reference to the accompanying drawings.

Figure 1:
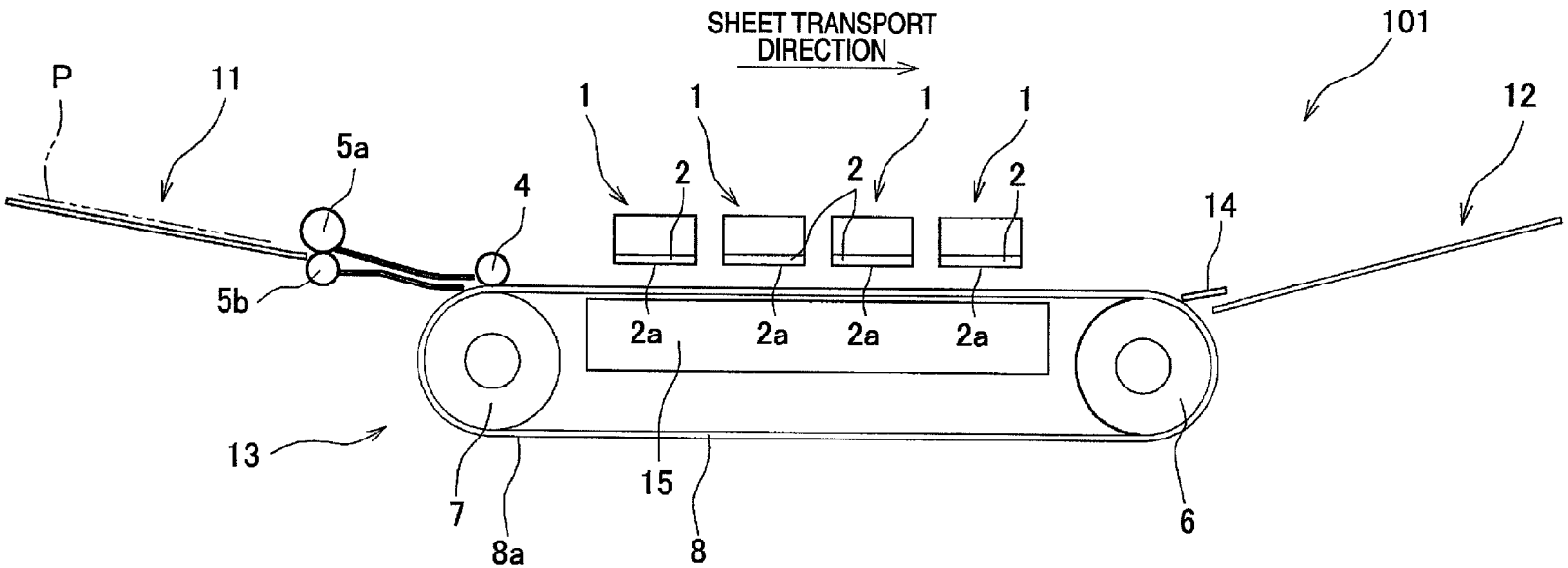
FIG. 1 is an external side view of an inkjet printer having inkjet heads according to an exemplary embodiment of the present invention.

FIG. 1 is a schematic side view showing an overall configuration of an inkjet printer having an inkjet head of an exemplary embodiment according to the present invention. As shown in FIG. 1, an inkjet printer 101 is a color inkjet printer having four inkjet heads 1. This inkjet printer 101 includes a sheet feeding unit 11, which is disposed on a left-hand side, and a sheet discharging unit 12, which is disposed on a right-hand side of the inkjet printer 101 as viewed in the figure.

A sheet transport path is formed in an interior of the inkjet printer 101, and a sheet P is transported from the sheet feeding unit 11 towards the sheet discharging unit 12 along the sheet transport path so formed. A pair of forwarding rollers 5*a*, 5*b* is disposed directly downstream of the sheet feeding unit 11, and the sheet P is held and transported downstream by the pair of forwarding rollers 5*a*, 5*b* so disposed. The pair of forwarding rollers 5*a*, 5*b* is provided for sending the sheet P to the right in the figure. A transport mechanism 13 is provided in a middle portion of the sheet transport path. This transport mechanism 13 includes two belt rollers 6, 7, an endless transport belt 8 which is looped around the two belt rollers 6, 7 so as to be extended therebetween and a platen 15 which is disposed within an area surrounded by the transport belt 8. The platen 15 is provided for supporting the transport belt 8 in a position which confronts the inkjet heads 1 so as to prevent a downward deflection of the transport belt 8. A nip roller 4 is disposed in a position which confronts the belt roller 7. The nip roller 4 is provided for pressing a sheet P which is fed out of the sheet feeding unit 11 by the forwarding rollers 5*a*, 5*b* against an outer circumferential surface 8*a* of the transport belt 8.

By a transport motor, rotating the belt roller 6, the transport belt 8 is caused to run in a circle. By this action, the transport belt 8 transports the sheet P pressed against the outer circumferential surface 8*a* by the nip roller 4 towards the sheet discharging unit 12 while holding the sheet P thereon in an adhesive fashion. In addition, a silicone resin layer having weak adhesion is formed on the surface of the transport belt 8.

A separation plate 14 is provided directly downstream of the transport belt 8. The separation plate 14 is configured so as to separate the sheet P adhering to the outer circumferential surface 8*a* of the transport belt 8 from the outer circumferential surface 8*a*, so as to guide the sheet P towards the sheet discharging unit 2 lying on a right-hand side thereof as viewed in the figure.

The four inkjet heads 1 are aligned in a sheet transport direction so as to correspond to inks of four colors (magenta, yellow, cyan, black). Namely, this inkjet printer 101 is an in-line printer. Each inkjet head 1 has a head main body 2 at a lower end thereof. The head main body 2 has a rectangular parallelepiped shape which is elongated in a direction which is at right angles to the transport direction. In addition, a bottom surface of the head main body 2 constitutes an ink discharge surface 2*a* which confronts the outer circumferential surface 8*a* of the transport belt 8. When the sheet P which is being transported by the transport belt 8 sequentially pass just by lower sides of the four head main bodies 2, inks of the respective colors are discharged towards an upper surface, that is, a printing surface of the sheet P to thereby print a desired color image on the printing surface of the sheet P.

Figure 2:
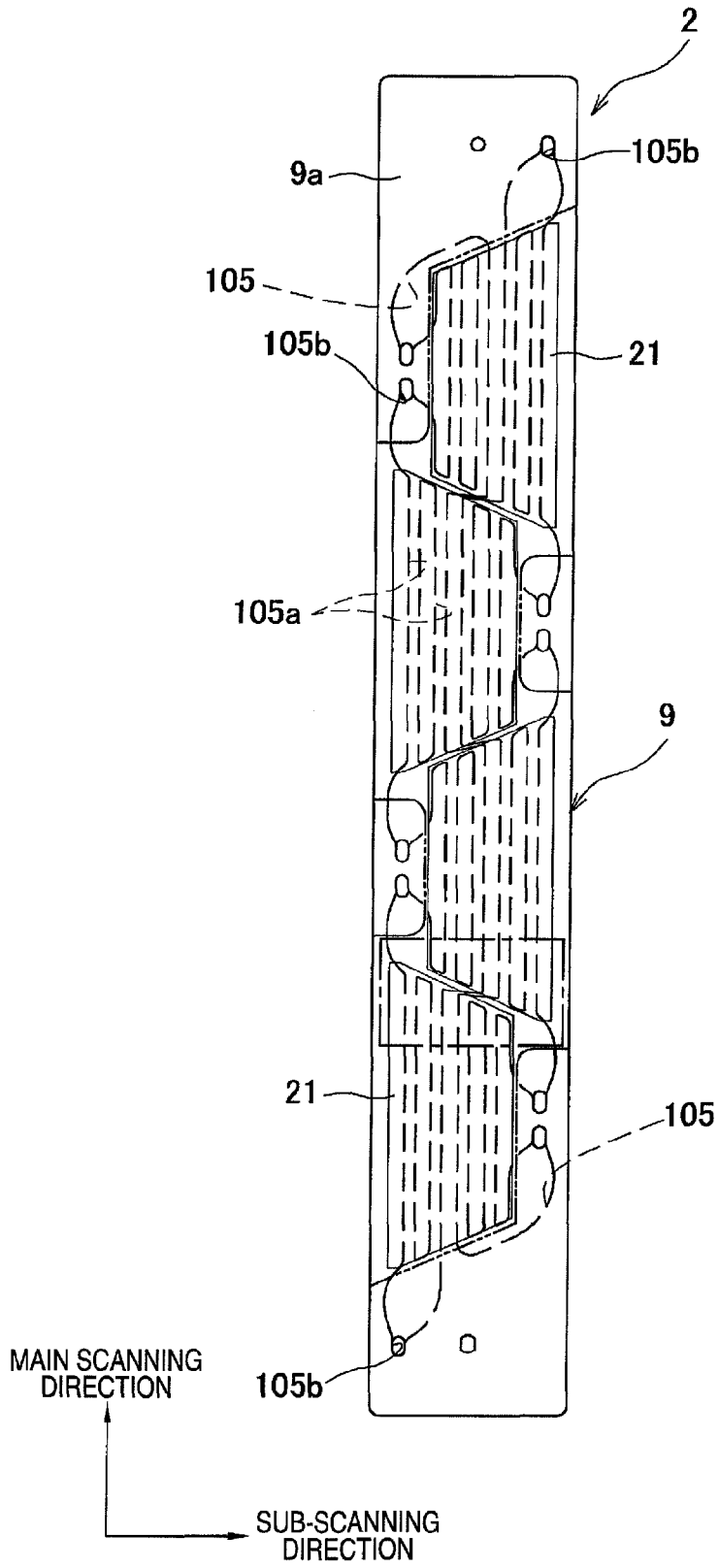
FIG. 2 is a plan view of a head main body shown in FIG. 1.
Figure 3:
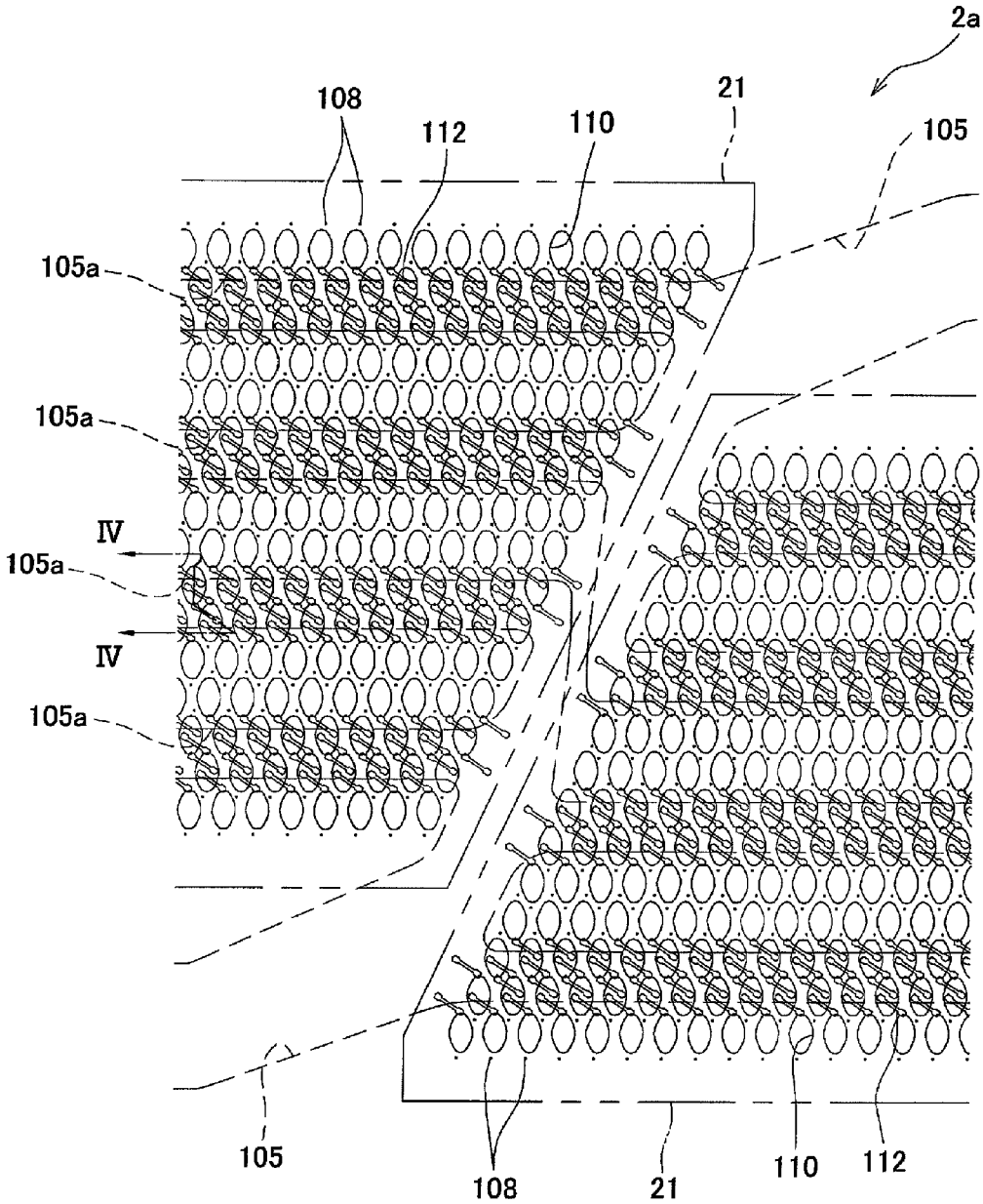
FIG. 3 is an enlarged view of an area surrounded by an alternate long and short dash line in FIG. 2.
Figure 4:
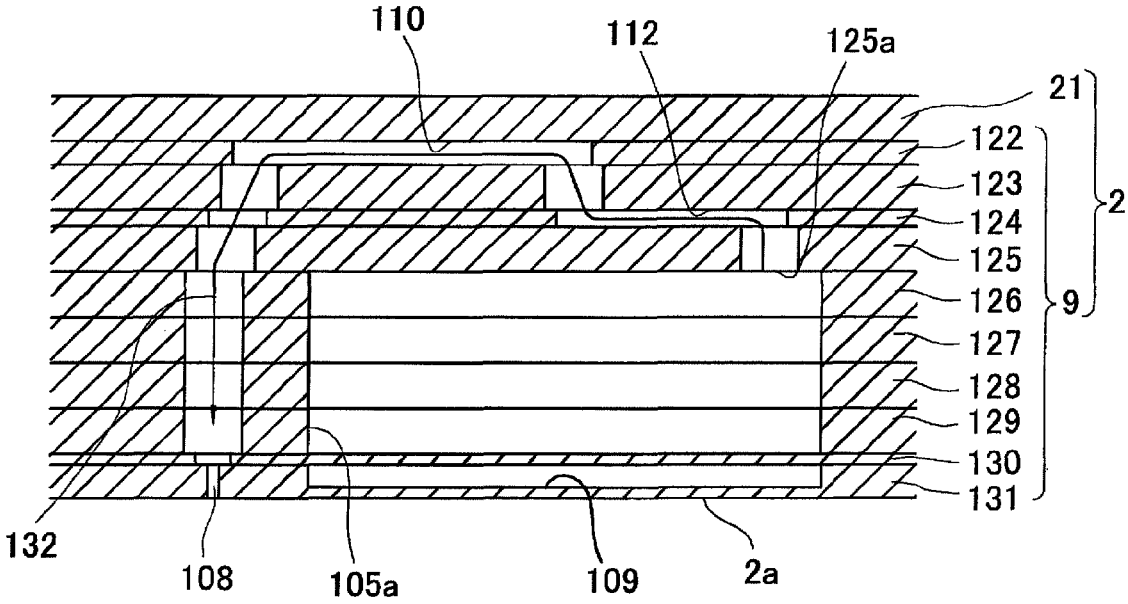
FIG. 4 is a sectional view taken along the line IV-IV shown in FIG. 3.

Next, referring to FIGS. 2 to 4, the head main body 2 will be described. FIG. 2 is a plan view of the head main body 2. FIG. 3 is an enlarged view of an area surrounded by an alternate long and short dash line in FIG. 2. In addition, as a matter of conveniences in illustration, pressure chambers 110, apertures 112 and nozzles 108 which are situated at lower portions in actuators 21 and, hence, should have been drawn by broken lines are drawn by solid lines. FIG. 4 is a partial sectional view taken along the line IV-IV shown in FIG. 3.

The head main body 2 makes up the inkjet head 1 by a driver IC for generating drive signals for driving actuator units 21, and a reservoir unit which supplies some of ink from an ink tank to a flow path unit 9 while storing therein other ink being built therein.

As shown in FIG. 2, in the head main body 2, four actuator units 21 are fixed to an upper surface 9*a* of the flow path unit 9. As shown in FIG. 3, in the flow path unit 9, ink flow paths including manifold flow paths 105 and pressure chambers 110 are formed in an interior thereof. The actuator unit 21 includes a plurality of actuators which correspond to the pressure chambers 110 individually and functions to selectively give discharging energy to ink in the pressure chambers 110 by the actuators being driven by the driver IC.

The flow path unit 9 has a rectangular parallelepiped shape. 10 ink supply ports in total are opened in the upper surface 9*a* of the flow path unit 9 so as to correspond to ink outlet ports of the reservoir unit. As shown in FIGS. 2 and 3, two manifold flow paths 105 are formed in the interior of the flow path unit 9, each manifold flow path being made to communicate with the five ink supply ports 105*b* which are arranged in a longitudinal direction (a main scanning direction) of the flow path unit 9 in the vicinity of end portions with respect to a transverse direction (a sub-scanning direction) of the flow path unit 9. In addition, each manifold flow path 105 has a plurality of sub-manifold flow paths 105*a* which branch off so as to be parallel to each other and to extend in the main scanning direction. An ink discharge surface 2*a* is formed on a lower surface of the flow path unit 9, and a large number of nozzles 108 are disposed in a matrix fashion on the ink discharge surface 2*a*. The pressure chambers 110 are also arranged in a large number in a similar matrix fashion to that of the nozzles 108 in a surface to which the actuators 21 are fixed.

In the exemplary embodiment, 16 rows of pressure chambers 110 are arranged parallel to each other in the transverse direction of the flow path unit 9, each row including pressure chambers 110 aligned at equal intervals in the longitudinal direction of the flow path unit 9. The numbers of pressure chambers 110 in the respective pressure chamber rows correspond to an external shape (a trapezoidal shape) of the actuator unit 21, which will be described later, and the rows of pressure chambers are arranged such that the numbers of pressure chambers in the rows decrease gradually from a longer side toward a shorter side of the trapezoidal shape. The nozzles 108 are also arranged in a similar way.

Further, as shown in FIG. 4, in the flow path unit 9, damper chambers 109 are formed so as to confront the sub-manifold flow path 105*a*. The damper chamber 9 is a space which is defined or held by a damper plate 130 and a nozzle plate 131, and here, the damper chamber 9 is defined by a recessed portion which is made to open to an upper surface of the nozzle plate 131 and a lower surface of the damper plate 130. By the damper plate 130 being elastically deformed in the damper chamber 109, a pressure fluctuation in the sub-manifold flow path 105*a* is suppressed. In addition, the nozzles 108 from which ink droplets are discharged are formed in the nozzle plate 131, and the damper plate 130 configures a bottom wall of the sub-manifold flow path 105*a*.

The flow path unit 9 includes 10 plates 122 to 131 which are made of a metallic material such as a stainless steel. The plates 122 to 131 (including a supply plate 125, manifold plates 126 to 129, a damper plate 130 and a nozzle plate 131) each have a rectangular flat surface which is elongated in the main scanning direction.

Through holes formed in the plates 122 to 131 are connected by stacking these plates 122 to 131 one on another while being aligned with each other, whereby the two manifold flow paths 105, a large number of individual ink flow paths 132 reaching the nozzles 108 from supply ports 125*a* which are outlets of the sub-manifold flow paths 105*a* related to each manifold flow path 105 via the pressure chambers 110 and the damper chambers 109 are formed in the flow path unit 9.

Next, the flow of ink in the flow path unit 9 will be described. Ink that is supplied from the reservoir unit into the flow path unit 9 via the ink supply ports 105*b* divides into the sub-manifold paths 105*a* in the manifold flow paths 105. Ink in the sub-manifold flow path 105*a* flows into the individual ink flow paths 132 and reaches the nozzles 108 via apertures 112 which function as diaphragms and the pressure chambers 110.

Figure 5:
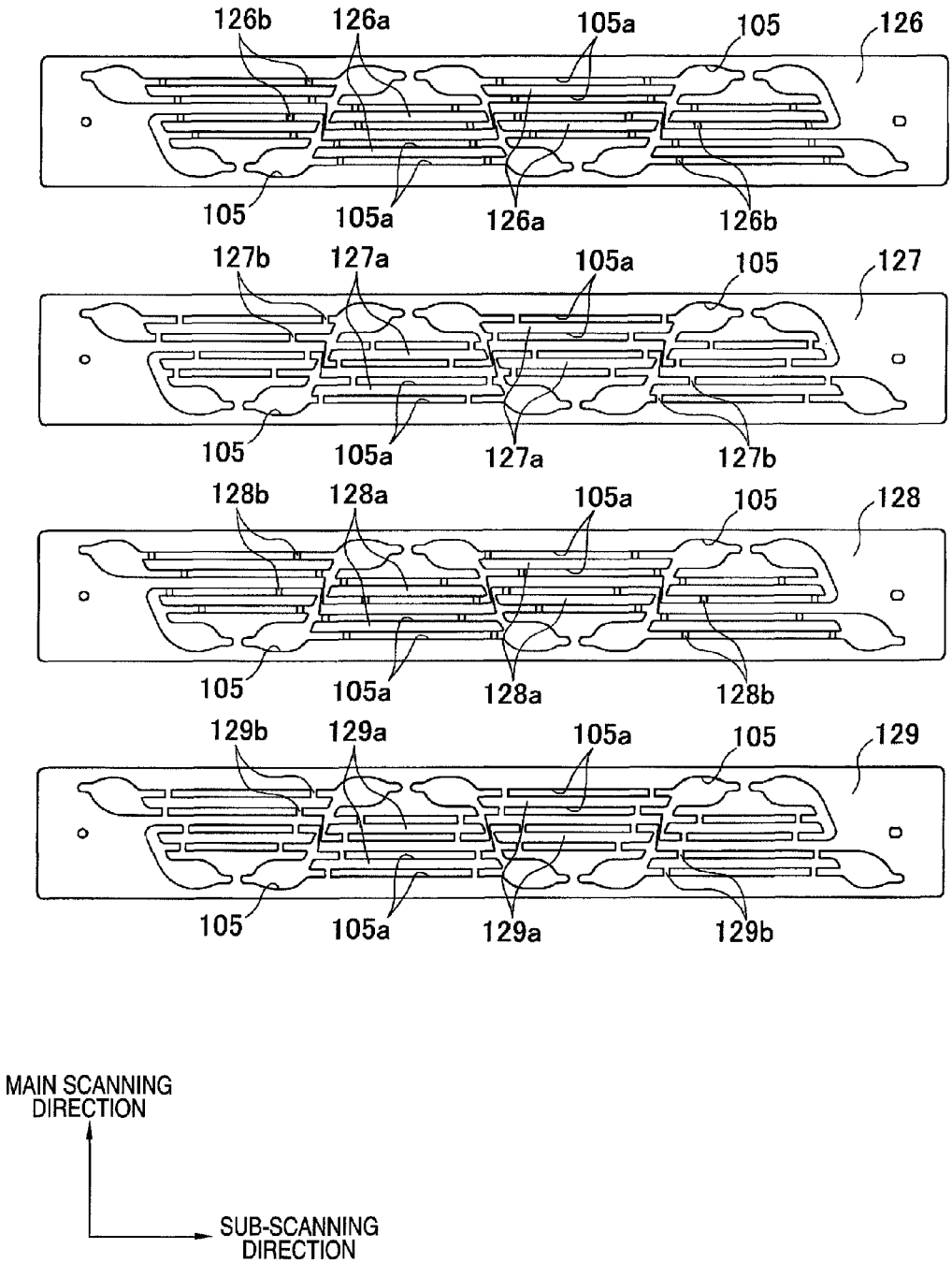
FIG. 5 is plan views of four manifold plates which form side walls of manifold flow paths shown in FIG. 2.
Figure 6:
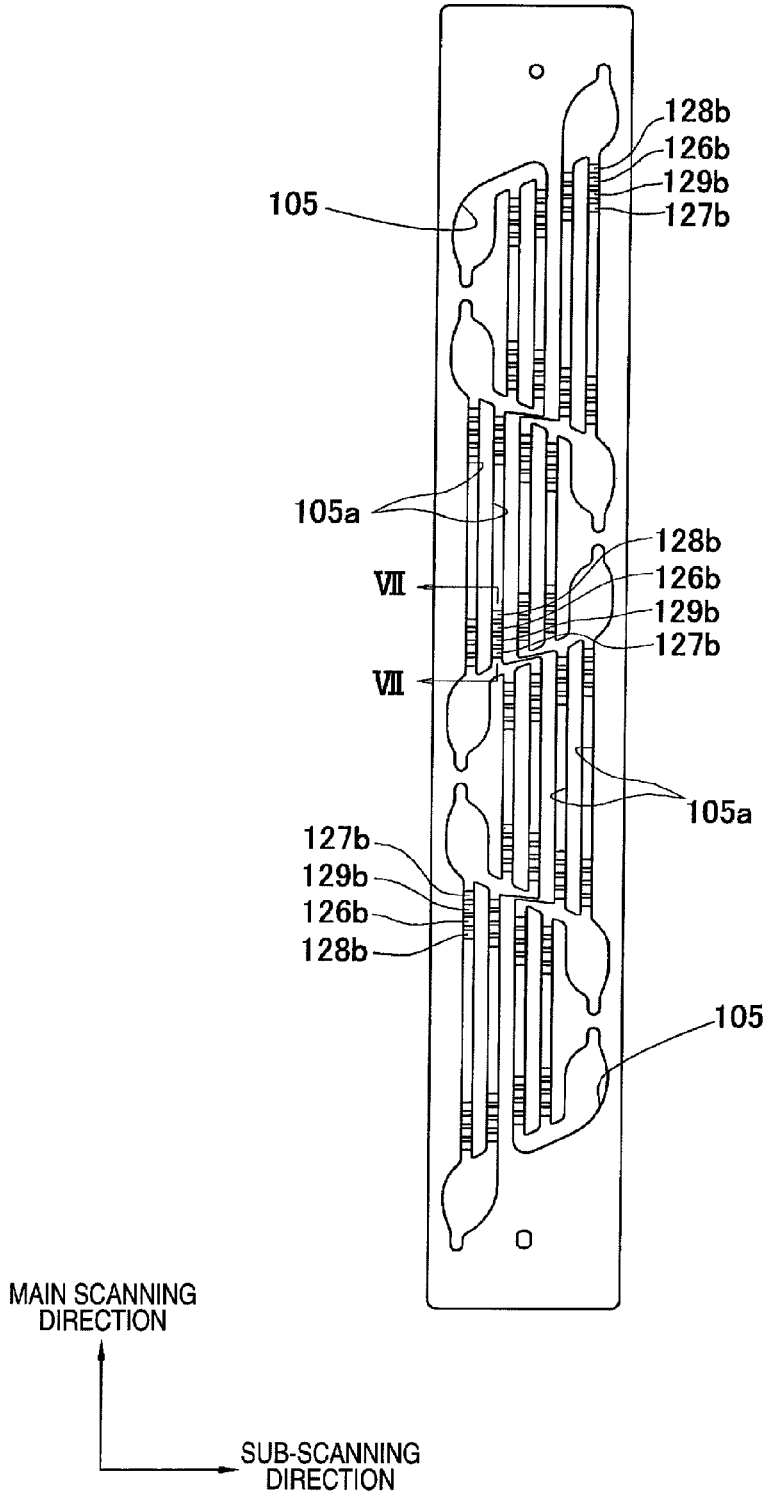
FIG. 6 is a plan view of the manifold flow paths shown in FIG. 2.
Figure 7:
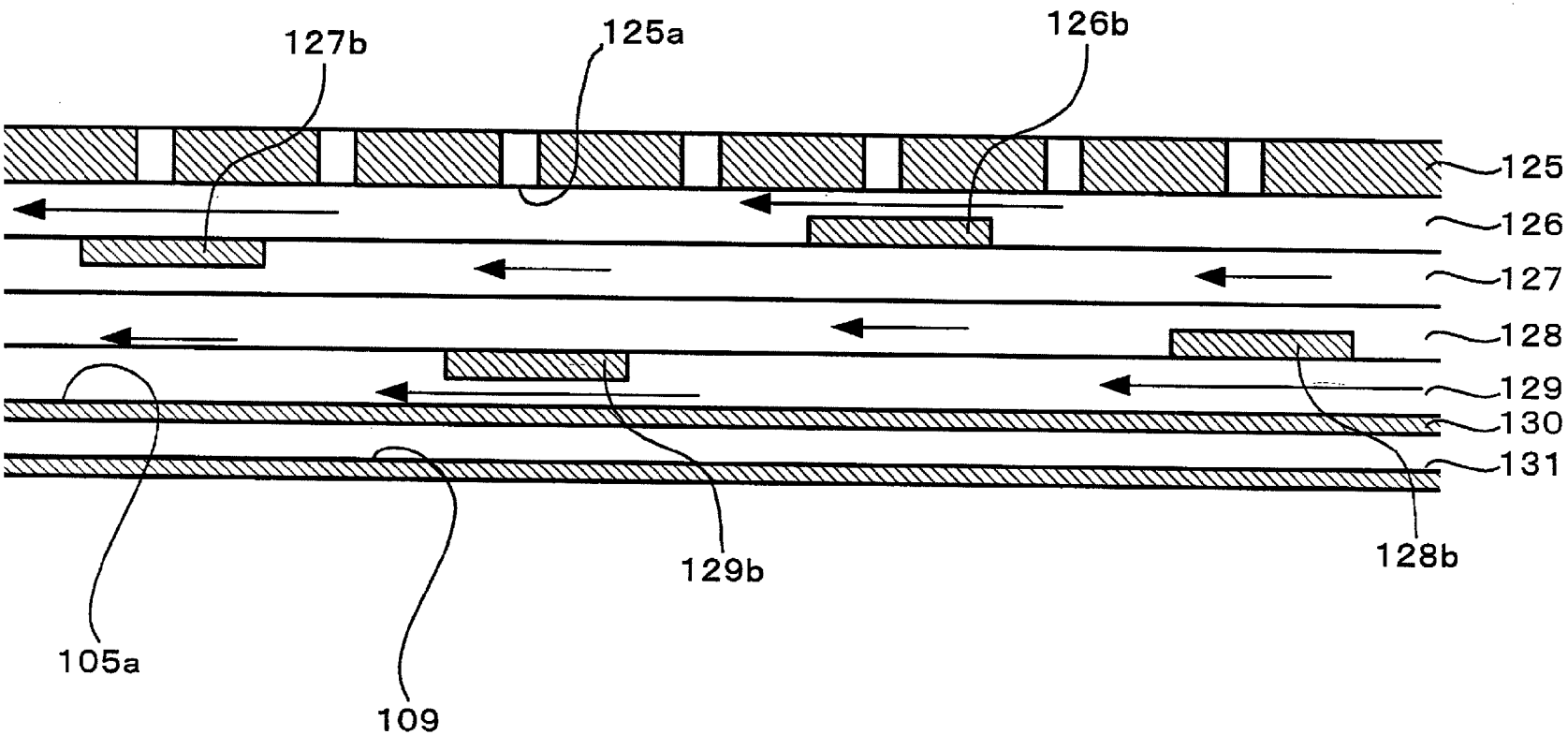
FIG. 7 is a sectional view taken along the line VII-VII shown in FIG. 6.

Next, referring to FIGS. 4 to 7, the manifold flow paths 105 (the sub-manifold flow paths 105*a*) will be described in detail. FIG. 5 is a plan view of the four manifold plates 126 to 129 which form side walls of the manifold flow paths 105. FIG. 6 is a plan view of the manifold flow paths 105. FIG. 7 is a sectional view in relation to the line VII-VII shown in FIG. 6. In addition, in FIG. 7, the supply plate 125, the damper plate 130 and the nozzle plate 131 which are not drawn in FIG. 6 are drawn. As is shown in FIG. 4, the manifold flow paths 105 are formed by the supply plate 125, the four manifold plates 126 to 129 and the damper plate 130 being stacked together sequentially. The supply plate 125 configures a ceiling wall of the manifold flow paths 105, and the supply ports 125*a* are formed which configure one end portions of the individual ink flow paths 132. The respective manifold plates 126 to 129 configure the side walls of the manifold flow paths 105. In addition, the damper plate 130 configures the bottom wall of the manifold flow paths 105.

As shown in FIG. 5, the manifold plates 126 to 129 each have a plurality of island-like partial plates 126*a*, 127*a*, 128*a*, 129*a* which are surrounded by the manifold flow paths 105 (the sub-manifold paths 105*a*) and which extend in one direction (in a direction in which the sub-manifold paths 105*a* extend). In this way, parts of side walls of the sub-manifold flow paths 105*a* are configured by the partial plates 126*a*, 127*a*, 128*a*, 129*a*. In addition, support pieces 126*b*, 127*b*, 128*b*, 129*b* are formed, respectively, on the manifold plates 126 to 129 so as to cross the sub-manifold flow paths 105*a* and to support the corresponding partial plates 126*a*, 127*a*, 128*a*, 129*a*.

As shown in FIGS. 6 and 7, an upper surface (a surface closer to the supply plate 125) of the support piece 126*b*, a lower surface (a surface closer to the damper plate 130) of the support piece 127*b*, an upper surface of the support piece 128*b* and a lower surface of the support piece 129*b* are all formed through half-etching. As a result of this operation, the upper surface of the support piece 126*b* is positioned lower than an upper surface of the partial plate 126*a*, the lower surface of the support piece 127*b* is positioned upper than a lower surface of the partial plate 127*a*, the upper surface of the support piece 128*b* is positioned lower than an upper surface of the partial plate 128*a*, and the lower surface of the support piece 129*b* is positioned upper than a lower surface of the partial plate 129*a*. The thickness of the support pieces 126*b*, 127*b*, 128*b*, 129*b* is substantially half the thickness of the partial plates 126*a*, 127*a*, 128*a*, 129*a*, which smoothes the flow of ink and bubbles in the sub-manifold flow paths 105*a*.

In addition, since the upper surface of the support piece 126*b* is spaced apart from a lower surface of the supply plate 125, the support piece does not interrupt the flow of ink reaching the individual ink flow path 132 from the outlet port 125*a* formed in the supply port 125. Further, since the lower surface of the support piece 129*b* is spaced apart from an upper surface of the damper plate 130, the support piece 129*b* does not interrupt the movement of the damper plate 130.

Here, the support pieces 127*b*, 128*b* are further described. In this exemplary embodiment, the support pieces 127*b*, 128*b* are formed, respectively, on the manifold plates 127, 128 which lie closest to the center of the sub-manifold flow paths 105*a*. On these two support pieces, the surface of the support piece 127*b* which lie closer to the center of the sub-manifold flow paths 105*a* is spaced farther from the center of the sub-manifold flow paths 105*a* than the central side surface of the manifold plate 127. On the other hand, the central side surface of the support pieces 128*b* is spaced farther from the center of the sub-manifold flow paths 105*a* than the central side surface of the support piece 128*b*. Because of this, the difference in flow velocity of ink between the sides of the support pieces 127*b*, 128*b* with respect to the stacking direction thereof becomes large. Because of this, bubbles caught on the support pieces 127*b*, 128*b* become easy to flow along the flow of ink with the high flow velocity.

In addition, the four support pieces 126*b*, 127*b*, 128*b*, 129*b* are arranged at predetermined intervals in the direction in which the sub-manifold flow paths extend in the vicinity of each end portion of each sub-manifold flow path 105*a* in the sub-manifold flow path extending direction. In this way, the adjacent support pieces 126*b*, 127*b*, 128*b*, 129 are spaced apart from each other in the direction in which ink flows.

In addition, one or two manifold plates of the four manifold plates 126 to 129 are interposed between the manifold plate 126 to 129 on which the support pieces 126*b*, 127*b*, 128*b*, 129*b* are formed and the different manifold plate 126 to 129 on which the support pieces 126*b*, 127*b*, 128*b*, 129*b* are formed which lie adjacent to the support pieces 126*b*, 127*b*, 128*b*, 129*b* in the direction in which the sub-manifold flow path 105*a* extends. In this way, the different manifold plate or plates are interposed between any two manifold plates which have the support pieces which lie adjacent to each other. Because of this, irrespective of the space in the flow path extending direction between the support pieces, bubbles are made to difficult to stay between the adjacent support pieces.

For example, in FIG. 7, the support piece 128*b*, the support piece 126*b*, the support piece 129*b*, the support piece 127*b* are arranged sequentially from a right-hand side of FIG. 7 in the direction in which the sub-manifold flow path 105*a* extends. The single manifold plate 127 is interposed between the manifold plate 128 on which the support piece 128*b* is formed and the manifold plate 126 on which the support piece 126*b* is formed. In addition, the two manifold plates 127, 128 are interposed between the manifold plate 126 on which the support piece 126*b* is formed and the manifold plate 129 on which the support piece 129*b* is formed. Further, the single manifold plate 128 is interposed between the manifold plate 129 on which the support piece 129*b* is formed and the manifold plate 127 on which the support piece 127*b* is formed.

In this way, the distances between the support pieces 126*b*, 127*b*, 128*b*, 129*b* which lie adjacent to one another in the extending direction of the sub-manifold flow path 105*a* are equal to or larger than the thickness of the respective manifold plates 126 to 129.

In addition, the four support pieces 126*b*, 127*b*, 128*b*, 129*b* are disposed alternately along the extending direction of the sub-manifold flow path 105*a* so as to be closer either to the supply plate 125 side or to the damper plate 130 side than the center with respect to the stacking direction of the sub-manifold flow path 105*a*. In other words, a relationship in magnitude between a distance between one surfaces of the support pieces 126*b*, 127*b*, 128*b*, 129*b* and a wall of the sub-manifold flow path 105*a* which confronts the one surfaces and a distance between the other surfaces of the support pieces 126*b*, 127*b*, 128*b*, 129*b* and a wall of the sub-manifold flow path 105*a* which confronts the other surfaces is different from the same relationship in magnitude between the support pieces 126*b*, 127*b*, 128*b*, 129*b* and the other support pieces 126*b*, 127*b*, 128*b*, 129*b* which are adjacent thereto in the extending direction of the sub-manifold flow path 105*a*.

In the respective support pieces 126*b*, 127*b*, 128*b*, 129*b*, as the distance to the walls of the sub-manifold flow path 105*a* decreases, the flow velocity of ink between the support pieces and the walls becomes fast. Consequently, the relationship in magnitude of the flow velocity in relation to the sides of the respective support pieces 126*b*, 127*b*, 128*b*, 129*b* with respect to the stacking direction switches along the extending direction for each of upon the support pieces 126*b*, 127*b*, 128*b*, 129*b*. Because of this, bubbles move while switching their rotating direction every time the bubbles pass by the support pieces 126*b*, 127*b*, 128*b*, 129*b*.

As has been described heretofore, according to the exemplary embodiment, since the distances between the support pieces 126*b*, 127*b*, 128*b*, 129*b* which lie adjacent in the extending direction of the sub-manifold flow path 105*a* are equal to or larger than the thickness of the support pieces 126*b*, 127*b*, 128*b*, 129*b*, the staying of bubbles between the support pieces 126*b*, 127*b*, 128*b*, 129*b* which lie adjacent in the way described above can be suppressed, thereby making it possible to discharge bubbles that have flowed into the sub-manifold flow path 105*a* therefrom with good efficiency.

In addition, the relationship in magnitude of the flow velocity in relation to the sides of the respective support pieces 126*b*, 127*b*, 128*b*, 129*b* with respect to the stacking direction switches along the extending direction for each of upon the support pieces 126*b*, 127*b*, 128*b*, 129*b*. Because of this, bubbles move while switching their rotating direction every time the bubbles pass by the support pieces 126*b*, 127*b*, 128*b*, 129*b*. By this action, the staying of bubbles between the adjacent support pieces 126*b*, 127*b*, 128*b*, 129*b* can be suppressed further.

Further, since the upper surface of the support piece 126*b* is spaced apart from the supply plate 125, the support piece 126*b* does not interrupt the flow of ink reaching the individual ink flow path 132 from the supply port 125*a* formed in the supply plate 125. Because of this, ink and bubbles within the sub-manifold flow path 105*a* can be caused to flow into the individual ink flow path 132 with good efficiency.

In addition to this, since the lower surface of the support piece 129*b* is spaced apart from the damper plate 130, the support piece 129*b* does not interrupt the movement of the damper plate 130. Because of this, the damper chamber 109 can suppress pressure fluctuation that would take place in the sub-manifold flow path 105*a*.

Additionally, with respect to the stacking direction, of the two surfaces of the support piece 127*b*, 128*b* which face the stacking direction, the surfaces of the support pieces 127*b*, 128*b* which lie closer to the center of the sub-manifold flow path 105*a* are spaced farther apart from the center than, of the two surfaces of the manifold plates 127, 128 on which the support pieces 127*b*, 128*b* are formed which are oriented in the stacking direction, the surfaces which lie closer to the center. According to this configuration, since the difference in flow velocity at the sides of the support pieces 127*b*, 128*b* with respect to the stacking direction becomes large, bubbles caught on the support pieces 127*b*, 128*b* become easy to flow along the flow of ink with such an increased flow velocity, thereby making it possible to suppress further the staying of bubbles in the sub-manifold flow path 105*a*.

Further, since the thickness of the support pieces 126*b*, 127*b*, 128*b*, 129*b* is substantially half the thickness of the respective partial plates 126*a*, 127*a*, 128*b*, 129*a*, the flow of ink and bubbles in the sub-manifold flow path 105*a* becomes smooth.

In addition to this, since the adjacent support pieces 126*b*, 127*b*, 128*b*, 129*b* are spaced apart from one another with respect to the ink flowing direction, the staying of bubbles between the adjacent support pieces 126*b*, 127*b*, 128*b*, 129*b* can be suppressed further.

Modified Exemplary Embodiment

Figure 8:
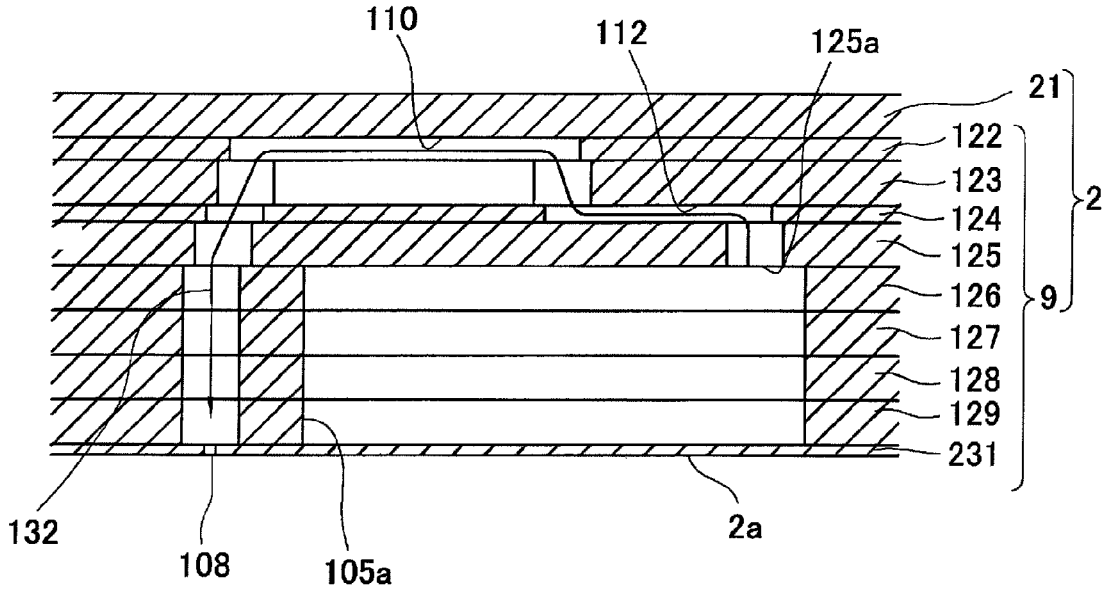
FIG. 8 is a diagram showing a modified example.

In the above described exemplary embodiment, the damper chamber 109 is formed by the damper plate 130 which lies adjacent to the manifold plate 129 and has a thin plate shape and the recessed portion of the nozzle plate 131 which has also a thin plate shape, the recessed portion being made to open to the upper surface of the nozzle plate 131. However, as shown in FIG. 8, a nozzle plate 231 which has a thin plate shape may be made to lie adjacent to the manifold plate 129. According to this modified exemplary embodiment, the nozzle plate 231 doubles as a damper plate to elastically be deformed, whereby pressure fluctuation in the sub-manifold flow path 105*a* can be suppressed.

Thus, while the exemplary embodiment of the invention has been described heretofore, the invention is not such as to be limited to the exemplary embodiment that has been described above but can be modified variously without departing from the scope of the claims of the invention. For example, in the embodiment described above, while the four manifold plates 126 to 129 are made to form the side walls of the manifold flow paths 105, a configuration may be adopted in which five manifold plates configure the side walls of the manifold flow paths 105. Also in the event that this configuration is adopted, one or a plurality of other manifold plates of the five manifold plates are interposed between the manifold plate on which the support piece is formed and the different manifold plate on which the support piece is formed which lies adjacent thereto in the extending direction of the manifold flow path 105*a*.

In addition, in the exemplary embodiment described above, while the relationship in magnitude between the distance between one surfaces of the support pieces 126*b*, 127*b*, 128*b*, 129*b* and the wall of the sub-manifold flow path 105*a* which confronts the one surfaces and the distance between the other surfaces of the support pieces 126*b*, 127*b*, 128*b*, 129*b* and the wall of the sub-manifold flow path 105*a* which confronts the other surfaces is different from the same relationship in magnitude between the support pieces 126*b*, 127*b*, 128*b*, 129*b* and the other support pieces 126*b*, 127*b*, 128*b*, 129*b* which are adjacent thereto in the extending direction of the sub-manifold flow path 105*a*, a configuration may be adopted in which the former relationship in magnitude is not different from the latter relationship in magnitude.

Further, in the embodiment described above, while the upper surface of the support piece 126*b* is made to be separated from the supply plate 125, the upper surface of the support piece may be in contact with the supply plate 125 in areas where the supply ports 125*a* are not opened.

In addition to this, in the embodiment described above, while the lower surface of the support piece 129*b* is made to be spaced apart from the bottom wall (the damper plate 130) of the sub-manifold flow path 105*a*, the lower surface of the support piece may be in contact with the bottom wall. When the lower surface of the support piece is in contact with the bottom wall, the bottom wall preferably does not have the damper function.

Additionally, in the embodiment described above, while the configuration is adopted in which the upper surface of the support piece 126*b* is positioned lower than the upper surface of the partial plate 126*a*, the lower surface of the support piece 127*b* is positioned upper than the lower surface of the partial plate 127*a*, the upper surface of the support piece 128*b* is positioned lower than the upper surface of the partial plate 128*a*, and the lower surface of the support piece 129*b* is positioned upper than the lower surface of the partial plate 129*a*, the other surfaces of the respective support pieces may be positioned upper or lower than the surfaces of the corresponding partial plates 126*a*, 127*a*, 128*a*, 129*a*. Alternatively, the sides of at least any of the support pieces may be positioned in the same position as the surfaces of the corresponding partial plate 126*a*. In the event that the sides of the support piece are positioned in the same position as the surfaces of the corresponding partial plate, from the viewpoint that the staying of bubbles becomes difficult to take place, such a support piece is preferably formed on the partial plate which lies closer to the center of the sub-manifold flow path 105*a*.

Furthermore, in the embodiment described above, while the adjacent support pieces 126*b*, 127*b*, 128*b*, 129*b* are spaced apart from one another in the ink flowing direction, the adjacent support pieces may lie adjacent to one another in the ink flowing direction, or at least part of the adjacent support pieces may be overlapped.

In the embodiment described above, while the damper chamber 109 is formed on the bottom wall side of the sub-manifold flow path 105*a*, the damper chamber may be formed on the ceiling wall side of the sub-manifold flow path 105*a*. When the damper chamber is formed on the ceiling wall side of the sub-manifold flow path 105*a*, the damper chamber needs to be formed in such a manner as to avoid the supply port 125*a* formed in the ceiling wall.

Figure 9:
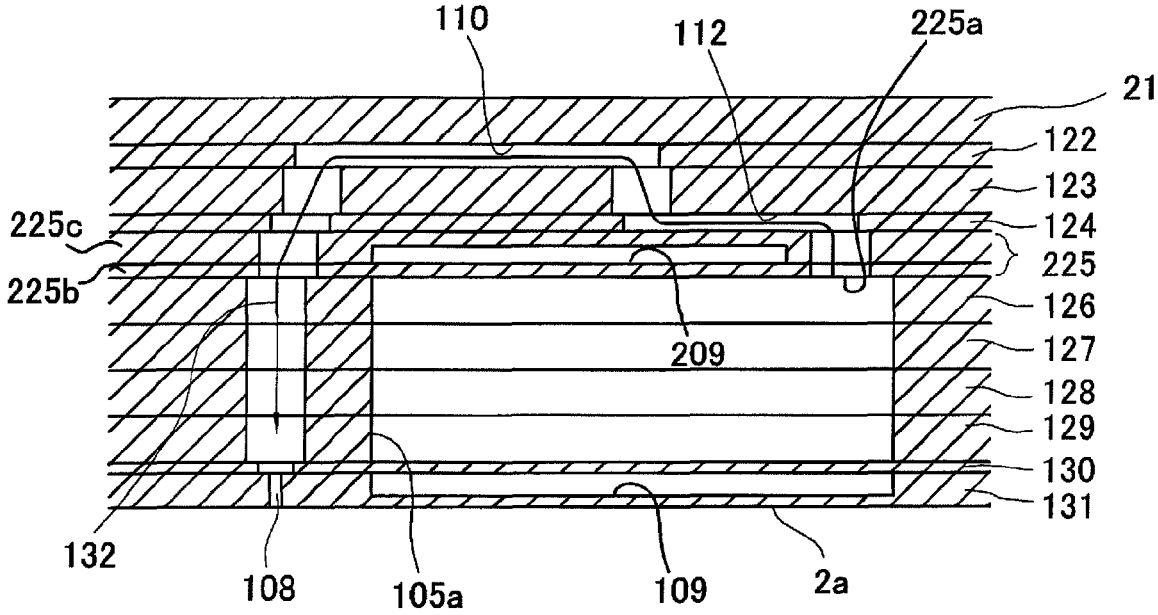
FIG. 9 is a diagram showing another modified example.

For example, as shown in FIG. 9, a damper chamber 209 is formed so as to confront a sub-manifold flow path 105*a*. A supply plate 225 has a double plate configuration in which it is made up of a lower plate 225*b* and an upper plate 225*c*. Of these constituent plates, the lower plate 225*b* is thinnest compared with the other plates and doubles as a damper plate. The damper chamber 209 configures a space held by the lower plate 225*b* and the upper plate 225*c* and is defined by a recessed portion formed on a lower surface of the upper plate 225*c* and an upper surface of the lower plate 225*b*. The supply plate 225 has a through port 225*a* which is formed so as to penetrate through the lower plate 225*b* and the upper plate 225*c*, and the recessed portion on the upper plate 225*c* is formed over an overall width of the sub-manifold flow path 105*a* while avoiding the supply port 225*a*. The lower plate 225*b* configures a ceiling wall of the sub-manifold flow path 105*a*.

In this case, from the viewpoint of suppressing the staying of bubbles, an upper surface of a support piece 126*b* on a manifold plate 126 is preferably spaced apart from the lower surface of the lower plate 225*b*. By this configuration, the support piece 126*b* will never interrupt the ink supplying capability from the supply port 225*a* and the pressure fluctuation suppressing effect by the elastic deformation of the lower plate 225*b*.

Thus, while the configurations in which the arrangement and external shapes of the support pieces are devised have been described based on the embodiment in which the flow path unit has the damper chambers, the flow path unit may have no damper chamber.

According to a first aspect of the present invention, there is provided a liquid discharging head including a flow path unit in which a plurality of common liquid flow paths and a plurality of individual ink flow paths which reach nozzles from outlets of the common liquid flow paths are formed by stacking a plurality of plates, wherein at least parts of side walls of the common liquid flow paths are configured by walls of island-like partial plates which are surrounded by the common liquid flow paths, wherein support pieces are formed on four or more manifold plates of the plurality of plates which configure the walls of the common flow paths in such a manner as to cross the common liquid flow paths and to support the walls of the partial plates, and wherein one or a plurality of manifold plates of the four or more manifold plates are disposed between the manifold plate on which the support piece is formed and the different manifold plate on which the support piece is formed which lies adjacent to the support piece in a direction in which the common liquid flow paths extend.

According to the first aspect of the invention, since the distance between the support pieces which lie adjacent to each other in the direction in which the common liquid flow paths extend with respect to the stacking direction becomes wide, the staying of bubbles between the adjacent support pieces can be suppressed. By this configuration, bubbles that have flowed into the common liquid flow paths can be discharged with good efficiency.

According to a second aspect of the present invention, a relationship in magnitude between a distance between one surface of the support piece and a wall surface of the common liquid flow path which confronts the one surface and a distance between the other surface of the support piece and a wall surface of the common liquid flow path which confronts the other surface is preferably different from the same relationship in magnitude between the support piece and the support piece which lies adjacent to the support piece in the common liquid flow path extending direction, with respect to a stacking direction of the four or more manifold plates. According to this configuration, the relationship in magnitude of flow velocity between the sides of each support piece with respect to the stacking direction changes from support piece to support piece along the extending direction. Because of this, every time bubbles pass by the support piece, the bubbles move or flow while switching the rotating direction thereof. This can suppress further the staying of bubbles between the adjacent support pieces.

In addition, according to a third aspect of the present invention, the outlets are preferably formed in a supply plate which becomes a ceiling wall of the common liquid flow paths, and the support pieces formed on the manifold plate which is adjacent to the supply plate are preferably spaced apart from the supply plate. According to this configuration, since the support pieces are made difficult to interrupt the flow of liquid reaching the individual liquid flow paths from the outlets of the common liquid flow paths, liquid and bubbles within the common liquid flow paths can be caused to flow into the individual liquid flow paths with good efficiency.

Further, according to a fourth aspect of the present invention, the flow path unit may become a bottom wall of the common liquid flow paths and have a nozzle plate in which the nozzles are formed, and the support pieces formed on the manifold plate which lies adjacent to the nozzle plate may be spaced apart from the nozzle plate.

Also, according to a fifth aspect of the present invention, the flow path unit may have a damper plate which becomes a bottom wall of the common liquid flow paths, and a nozzle plate in which the nozzles are formed and which forms with the damper plate a damper chamber which confronts the common liquid flow paths via the damper plate, and the support pieces formed on the manifold plate which lies adjacent to the damper plate may be space apart from the damper plate.

According to this configuration, since the support pieces do not disturb the movement of the damper plate, the pressure fluctuation in the common liquid flow paths can be suppressed with good efficiency.

Also, according to a sixth aspect of the present invention, with respect to a stacking direction of the four or more manifold plates, of two surfaces of the support piece which face the stacking direction, a surface of the support piece which lies closer to a center of the common liquid flow paths is preferably spaced farther apart from the center than, of two faces of the manifold plate on which the support piece is formed which face the stacking direction, a surface which lies closer to the center. According to this configuration, since the difference in magnitude of flow velocity between the sides of the support piece with respect to the stacking direction is increased, bubbles caught on the support pieces become easy to flow along the flow liquid whose flow velocity is so increased, whereby the staying of bubbles within the common liquid flow paths can be suppressed further.

According to a seventh aspect of the present invention, the thickness of the support pieces formed on all the manifold plates is preferably thinner than the thickness of partial plates. According to this configuration, since the thickness of the support pieces become thin, the flow of liquid and bubbles within the common liquid flow paths can be made smooth.

Additionally, according to an eighth aspect of the present invention, the support pieces are preferably disposed spaced apart from the different support pieces which lie adjacent thereto in the common liquid flow path extending direction, with respect to the common liquid flow path extending direction. According to this configuration, since the adjacent support pieces are spaced apart from each other with respect to the direction in which liquid flows, the staying of bubbles between the adjacent support pieces can be suppressed.

According to a ninth aspect of the present invention, there is provided an ink-jet head including a flow path unit in which a common ink flow path, a plurality of branch ink flow paths which branch off from the common ink flow path, and a plurality of individual ink flow paths which reach nozzles from outlets of the branch ink flow paths via pressure chambers are formed by a plurality of metallic plates including four or more manifold plates being stacked together, wherein the common ink flow path, the branch ink flow paths, island-like partial plates which are surrounded along the full circumference thereof by the branch ink flow paths and support pieces which are disposed in such a manner as to cross the branch ink flow paths and to support the partial plates by connecting together side walls of the branch ink flow paths which confront each other across the branch ink flow paths are formed in the four or more manifold plates, and wherein one or a plurality of manifold plates of the four or more manifold plates are disposed, with respect to the stacking direction, between the manifold plate on which the support pieces are formed and the different manifold plate on which the support pieces are formed which lie adjacent to the support pieces in a direction in which the branch ink flow paths extend.

What is claimed is:

1. A liquid discharging head comprising:

a flow path unit comprising: a common liquid flow path;

an individual liquid flow path that reaches a nozzle from an outlet of the common liquid flow path; and a plurality of plates that are stacked to form the common liquid flow path and the individual liquid flow path, the plurality of plates comprising at least four manifold plates that include partial plates and support members, wherein each of the at least four manifold plates comprises:

a respective one of the partial plates, which has an island shape, and which is surrounded by the common liquid flow path; and a respective one of the support members that connects walls of the partial plates to side walls of the common liquid flow path so as to cross the common liquid flow path, the side walls of the common liquid flow path comprising the walls of the partial plates, and wherein the at least four manifold plates comprise:

a first manifold plate that includes a first partial plate and a first support member that supports the first partial plate;

a second manifold plate that includes a second partial plate and a second support member that is adjacent to the first support member in a direction in which the common liquid path extends, the second support member supporting the second partial plate; and at least one manifold plate that is interposed between the first manifold plate and the second manifold plate, wherein the at least one manifold plate interposed between the first manifold plate and the second manifold plate comprises a third partial plate and a third support member configured to support the third partial plate, and the third support member is not interposed between the first support member and the second support member in a stacking direction of the manifold plates.

2. The liquid discharging head according to claim 1, wherein a first magnitude relationship between a distance between one surface of the first support member and a wall surface of the common liquid flow path which faces to the one surface of the first support member and a distance between an other surface of the first support member and a wall surface of the common liquid flow path which faces to the other surface of the first support member is different from a second magnitude relationship between a distance between one surface of the second support member and a wall surface of the common liquid flow path which faces to the one surface of second support member and a distance between an other surface of the second support member and a wall surface of the common liquid flow path which faces to the other surface of the second support member, in a stacking direction in which the at least four manifold plates stack.

3. The liquid discharging head according to claim 1, wherein the plurality of plates further comprises a supply plate that is a ceiling wall of the common liquid flow path, the supply plate comprising the outlets of the common liquid flow path, and wherein the support member, which is formed on the manifold plate that is adjacent to the supply plate, and which is spaced apart from the supply plate.

4. The liquid discharging head according to claim 1, wherein the plurality of plates further comprises a nozzle plate that is a bottom wall of the common liquid flow path, the nozzle plate comprising the nozzle of the flow path unit, and wherein the support member, which is formed on the manifold plate that is adjacent to the nozzle plate, and which is spaced apart from the nozzle plate.

5. The liquid discharging head according to claim 1, wherein the plurality of plates further comprises:

a damper plate that is a bottom wall of the common liquid flow path; and a nozzle plate that comprise the nozzle of the flow path unit, wherein a damper chamber is formed by the damper plate and the nozzle plate, the damper chamber facing to the common liquid flow path across the damper plate, and the support member, which is formed on the manifold plate that is adjacent to the damper plate, and which is spaced apart from the damper plate.

6. The liquid discharging head according to claim 1, wherein of two surfaces of the support member as viewed from the stacking direction, a surface of the support member which is closer to a center of the common liquid flow path is spaced farther apart from the center than, of two faces of the manifold plate on which the support member is formed as viewed from the stacking direction, a face of the manifold plate which is closer to the center.

7. The liquid discharging head according to claim 1, wherein a thickness of the support members formed on all the manifold plates is thinner than a thickness of the partial plates.

8. The liquid discharging head according to claim 1, wherein the first support member is disposed spaced apart from the second support member that is adjacent to the first support member in the direction in which the common liquid path extends.

9. A inkjet head comprising:

a flow path unit comprising:

a common ink flow path;

a plurality of branch ink flow paths that branch off from the common ink flow path;

a plurality of individual ink flow paths that reach nozzles from outlets of the branch ink flow paths through pressure chambers; and a plurality of metallic plates that are stacked to form the common liquid flow path, the branch ink flow paths and the individual liquid flow paths, the plurality of metallic plates comprising at least four manifold plates that include the common liquid flow path, the branch ink flow paths, partial plates and support members, wherein each of the at least four manifold plates comprises:

a respective one of the partial plates, which has an island shape, and which is surrounded by a respective one of the branch ink flow paths; and a respective one of the support members that connects side walls of the respective branch ink flow path so as to support the respective partial plate and to cross the common liquid flow path, and wherein the at least four manifold plates comprise:

a first manifold plate that includes a first partial plate and a first support member that supports the first partial plate; and a second manifold plate that includes a second partial plate and a second support member that is adjacent to the first support member in a direction in which the branch ink flow paths extend, the second support member supporting the second partial plate; and at least one manifold plate that is interposed between the first manifold plate and the second manifold plate, and wherein the at least one manifold plate interposed between the first manifold plate and the second manifold plate comprises a third partial plate and a third support member configured to support the third partial plate, and the third support member is not interposed between the first support member and the second support member in a stacking direction of the manifold plates.

* * * * *